US010211527B2

(12) United States Patent
Safavi-Naeini et al.

(10) Patent No.: US 10,211,527 B2
(45) Date of Patent: Feb. 19, 2019

(54) METHOD AND APPARATUS FOR PHASED ANTENNA ARRAY CALIBRATION

(71) Applicant: C-COM Satellite Systems Inc., Ottawa (CA)

(72) Inventors: Safieddin Safavi-Naeini, Waterloo (CA); Mohammad Haghtalab, Waterloo (CA)

(73) Assignee: C-COM Satellite Systems Inc., Ottawa (CA)

( * ) Notice: Subject to any disclaimer, the term of this patent is extended or adjusted under 35 U.S.C. 154(b) by 292 days.

(21) Appl. No.: 15/299,920

(22) Filed: Oct. 21, 2016

(65) Prior Publication Data

US 2018/0115064 A1 Apr. 26, 2018

(51) Int. Cl.

| | |
|---|---|
| ***H01Q 3/00*** | (2006.01) |
| ***H01Q 3/26*** | (2006.01) |
| *H01Q 3/28* | (2006.01) |
| *H01Q 3/36* | (2006.01) |

(52) U.S. Cl.
CPC ..... *H01Q 3/267* (2013.01); *H01Q 3/28* (2013.01); *H01Q 3/36* (2013.01)

(58) Field of Classification Search
CPC ..... G01S 7/4004; H01Q 3/267; H01Q 3/36
USPC ..... 342/173–174, 196, 369, 372
See application file for complete search history.

(56) References Cited

U.S. PATENT DOCUMENTS 5,225,839 A * 7/1993 Okurowski ..... G01S 7/025 342/174
2016/0043778 A1* 2/2016 Sikina ..... H04B 5/0043 455/41.1

* cited by examiner

*Primary Examiner* — Dao L Phan
(74) *Attorney, Agent, or Firm* — Perkins Coie LLP

(57) ABSTRACT

A method and apparatus for calibrating a phased antenna array. The antennas are excited using several excitation patterns, each changing the state of the antennas by a specific amplitude and phase. The phases correspond to phase values of a basis function of a two-dimensional discrete Fourier transform, and each excitation pattern corresponds to a different basis function. Using a calibration antenna, e.g. at a fixed point inside the system, the phase and amplitude of the radiated field due to each excitation patterns is measured sequentially. From this data, the phase and amplitude of the radiated field for each element at the location of the calibration antenna is obtained and used to adjust the phase shifters and amplifiers. For calibrated systems, the spectral domain representation of radiated fields can be sparse. Taking advantage of this property and a spectrally compressed sensing technique, recalibration can involve fewer measurements to mitigate service interruptions.

21 Claims, 5 Drawing Sheets

METHOD AND APPARATUS FOR PHASED ANTENNA ARRAY CALIBRATION

FIELD OF THE INVENTION

The present invention pertains to the field of radio antennas and in particular to a method and apparatus for calibrating a phased antenna array.

BACKGROUND

A phased antenna array system includes a group of antennas being used for signal communication through transmission and reception of electromagnetic waves. In a typical implementation, each antenna is connected to a phase shifter and an amplifier, which control the phase and amplitude of the radiated electromagnetic wave for that antenna. Changing the amplitudes and phases of the signals feeding the array's different antennas leads to changes in the far field radiation pattern of system. The beam of the phased array can therefore be controllably directed.

Precise controlling of the array's amplifiers and phase shifters is important for altering the radiation pattern in terms of power level and beam direction. However, practical considerations, such as physical limitations, environmental conditions and fabrication process variations, impose unwanted errors on the amplitude and phase response of these components, resulting in non-ideal behaviour. Imperfections can also exist in the antenna feed network which is responsible for dividing the input power and distributing signals to antennas. Furthermore, the geometrical parameters such as the location of fabricated antennas are subject to error. Calibration can be used to counteract such imperfections and is considered to be an important part of the operation of a phased array system. Having a priori knowledge about the antennas radiation characteristics, calibration can provide information on various system parameters such as the phase and amplitude response of electrical components and the location of antennas.

Some existing calibration methods are based on changing the value of phase shifters for every single element sequentially, and maximizing the power received (for transmitting mode) or transmitted (for receiving mode) by one or an array of external reference antennas, which are typically located at a distance from the array. The values of phase shifters corresponding to the maximum received (transmitted) powers determine the offset to be applied to each phase shifter and amplifier. Other calibration methods control both the amplitude and phase of the radiated field for every phase shifter or antenna. Through applying the control signal, the phase responses of the array's component antennas are obtained.

However, performing these measurements for an array with large number of antennas can be a time consuming process, particularly because calibration is typically required to be done at least once for each element. Furthermore, from a system identification point of view, existing methods do not provide more detail on other unknown parameters of the system such as the geometrical parameters.

Therefore there is a need for a method and apparatus for phased antenna array calibration, that is not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present invention is to provide a method and apparatus for phased antenna array calibration. In accordance with embodiments of the present invention, there is provided a method for calibrating an antenna array comprising a plurality of antennas in a two-dimensional arrangement, each of the antennas operatively coupled to a respective controllable phase shifter, the method comprising: exciting the antennas according to a sequence of excitation patterns, each of the excitation patterns defining a plurality of phases to be applied by the phase shifters during concurrent excitation of the antennas, wherein the plurality of phases correspond to phase values of a basis function of a two-dimensional discrete Fourier transform, and wherein each of the excitation patterns is associated with a different basis function of the two-dimensional discrete Fourier transform; monitoring output of a calibration antenna to provide a sequence of measurements, each measurement of the sequence of measurements indicative of response of the calibration antenna due to a superposition of radiated fields of the antennas excited according to a corresponding one of the excitation patterns; obtaining indications of radiated fields of the antennas based on the sequence of measurements, the indications corresponding to values of an inverse two-dimensional discrete Fourier transform applied to the measurements; and calibrating the antenna array based on the indications of radiated fields of the antennas.

In accordance with other embodiments of the present invention, there is provided a calibration apparatus for an antenna array having a plurality of antennas in a two-dimensional arrangement, each of the antennas operatively coupled to a respective controllable phase shifter, the calibration apparatus comprising: a calibration antenna configured to generate an electrical signal in response to radiated fields generated by the antennas; a calibration controller configured to: cause excitation of the antennas according to a sequence of excitation patterns, each of the excitation patterns defining a plurality of phases to be applied by the phase shifters during concurrent excitation of the antennas, wherein the plurality of phases correspond to phase values of a basis function of a two-dimensional discrete Fourier transform, and wherein each of the excitation patterns is associated with a different basis function of the two-dimensional discrete Fourier transform; monitor output of the calibration antenna to provide a sequence of measurements, each measurement of the sequence of measurements indicative of response of the calibration antenna due to a superposition of the radiated fields of the antennas excited according to a corresponding one of the excitation patterns; obtain indications of radiated fields of the antennas based on the sequence of measurements, the indications corresponding to values of an inverse two-dimensional discrete Fourier transform applied to the measurements; and calibrate the antenna array based on the indications of radiated fields of the antennas.

In accordance with other embodiments of the present invention, there is provided a phased antenna array comprising the calibration apparatus as described above.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Embodiments of the present invention provide for the comparatively reliable, accurate and fast calibration and system identification for phased array antenna systems, involving significantly fewer measurements and less complexity than existing approaches.

An object of present invention is to provide a method and apparatus for calibrating a phased antenna array system based on measurements at a single point, namely the location of a calibration antenna, also referred to as a sensor. The calibration antenna may be located close to the antenna array, for example within or adjacent to the array. The calibration procedure provides estimates of the phase and amplitude responses of electrical components (e.g. electronic beam-forming components) of the phased array system. The calibration procedure can additionally indicate the errors associated with the feeding network and geometrical errors associated with the positioning of antennas.

Figure 1:
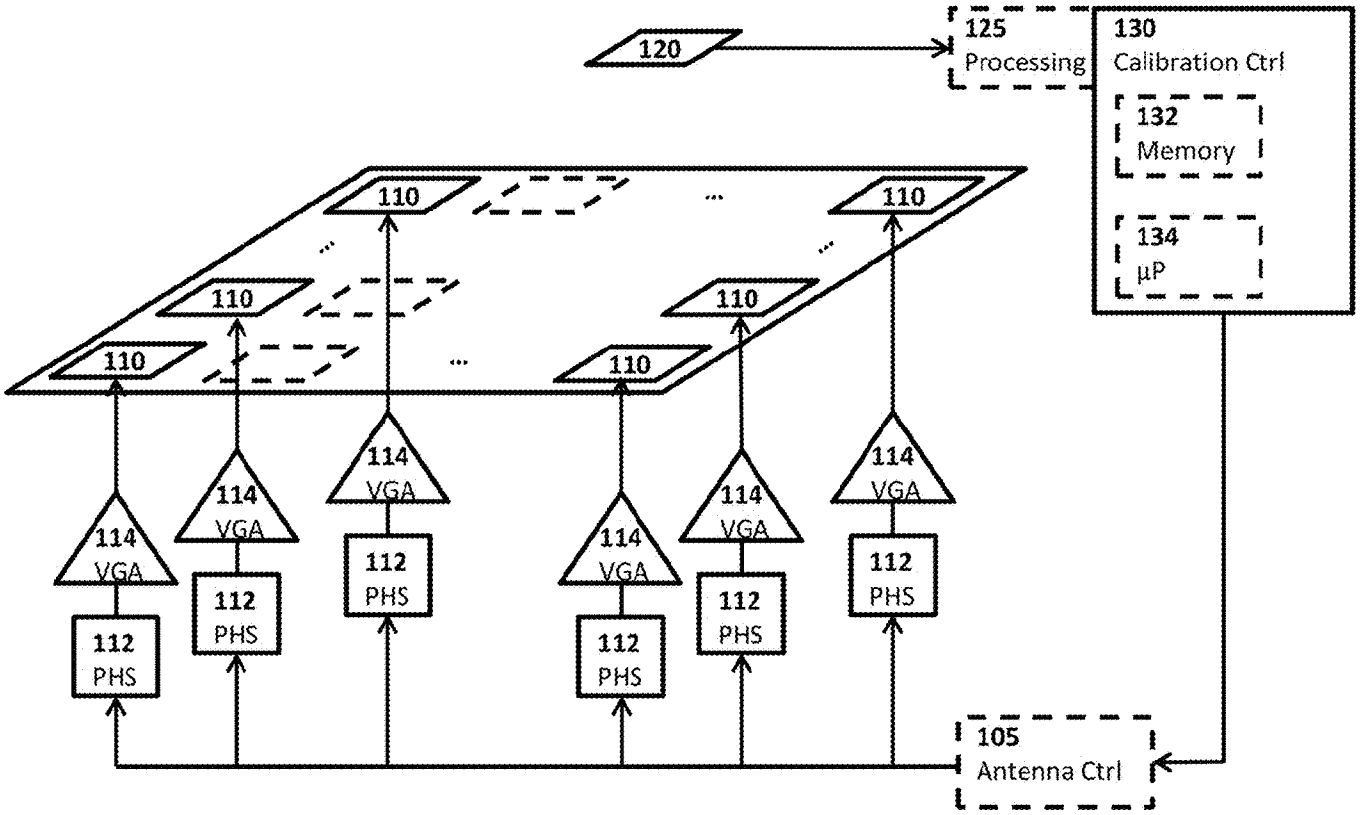
FIG. 1 illustrates a phased antenna array system and calibration apparatus, according to embodiments of the present invention.

FIG. 1 illustrates a phased antenna array system and calibration apparatus according to an embodiment of the present invention. The antenna array includes a plurality of antennas 110 in a two-dimensional arrangement. For clarity, the antennas 110 are shown as being arranged in a regular grid on a flat surface. However, other antenna arrangements, such as antennas disposed on a curved surface and/or a staggered or irregular distribution of antennas can also be accommodated. The antennas may form a conformal array (i.e. an array conforming to a predetermined flat or curved surface). Each of the antennas 110 is operatively coupled to a respective controllable phase shifter 112, and typically also to a controllable variable gain amplifier 114.

In some embodiments, each antenna is coupled to a different phase shifter. In some embodiments, each antenna is coupled to a different variable gain amplifier. Therefore, for an array of M×N antennas, a branched antenna feed network can terminate in M×N branches, each associated with a different antenna and having its own phase shifter and variable gain amplifier. In other embodiments, a single phase shifter (and variable gain amplifier) can be shared by plural antennas. In this case, embodiments of the present invention can be understood by regarding the plural antennas sharing a phase shifter as being a single compound antenna having multiple elements.

The calibration apparatus includes a calibration antenna 120 configured to generate an electrical signal in response to radiated fields generated by the antennas 110 due to excitation thereof. The calibration apparatus further includes a calibration controller 130 which is operatively coupled to the antenna array and to the calibration antenna. In particular, the calibration controller 130 is configured to cause a radiofrequency signal to be fed to the antennas 110, and to cause the phase shifters 112 and variable gain amplifiers 114 to adjust the radiofrequency signal by imparting gains and phase shifts which are specified by the calibration controller 130. In some embodiments, the calibration controller is directly coupled to a feed network of the antenna array and to control inputs of the phase shifters 112 and variable gain amplifiers 114. In some embodiments, the calibration controller is operatively coupled to existing antenna control electronics 105 which perform the antenna array excitation, phase shifter control and variable gain amplifier control. In the latter case, the calibration controller transmits control signals to the antenna control electronics to cause the desired manner of operation.

In various embodiments, processing electronics 125, such as radiofrequency and baseband processing electronics, are either included in the calibration controller 130 or interposed between the calibration antenna 120 and the calibration controller 130. The processing electronics receive and process the signal from the calibration antenna, for example by partially or fully demodulating the received signal of the calibration antenna and performing other operations such as signal conditioning, quantization, filtering, phase discrimination, and the like, as would be readily understood by a worker skilled in the art.

In more detail, the calibration controller 130 is configured to (directly or indirectly) cause excitation of the antennas 110 according to a sequence of excitation patterns. Each of the excitation patterns defines a plurality of phase shifts (phases) to be applied by the phase shifters 112 during concurrent excitation of multiple ones of the antennas 110. The phase shifts are applied for example to a common radiofrequency signal, such as a sinusoidal signal, which is fed (e.g. via a feed network of the antenna array) to the antennas 110 being excited by the current excitation pattern. Notably, the pattern of relative phase shifts correspond to phase values of a basis function of a two-dimensional discrete Fourier transform. Furthermore, each of the excitation patterns in the sequence is associated with a different basis function of the two-dimensional discrete Fourier transform. The gains of variable gain amplifiers 114 can also be set by the calibration controller 130 and/or antenna controller 105.

In various embodiments, each of the plurality of excitation patterns corresponds to a different two-dimensional discrete index value (k,l) between (1,1) and (K,L). In various embodiments K=M and L=N. In this case, for each of the index values (k,l), the basis function associated with the excitation pattern corresponding to the index value (k,l) is a two-dimensional function over discrete variables (m,n) given by:

$$e^{-j2\pi\left(\frac{mk}{M}+\frac{nl}{N}\right)}.$$

This is a typical basis function associated with the two-dimensional discrete Fourier transform. Each phase value, to be applied by a phase shifter, is given as the phase angle of the corresponding basis function for a given (m,n,k,l).

In various embodiments, the discrete variables (m,n) correspond to two-dimensional indices associated with the antennas in the M×N array. The indices may correspond to antenna spatial positions. For example, the variable (m,n) may denote that the corresponding antenna element is located in the $m^{th}$ row and $n^{th}$ column of a two-dimensional antenna array having its antennas arranged in a grid of M rows and N columns.

The calibration controller 130 is further configured to monitor output of the calibration antenna to provide a sequence of measurements. Each measurement of the sequence indicates an electrical response of the calibration antenna due to placement in a superposition of the radiated fields of the antennas of the array. As already noted, the radiated fields in turn are due to antenna excitation according to a corresponding one of the excitation patterns. As each measurement is received, it may be stored in an electronic memory 132 of the calibration controller, for subsequent retrieval and processing.

In some embodiments, the electrical response of the calibration antenna is, is assumed to be, and/or is filtered to provide, a sinusoidal signal. In some embodiments, the electrical response may provide, or may be filtered to provide, a narrowband signal having a particular amplitude and phase. As such, some or all measurements of the sequence of measurements may indicate amplitude and phase of a sinusoidal electrical signal provided by the calibration antenna due to its response to the superposition of radiated fields. The phase of this signal is relative to the common sinusoidal signal used to excite the array antennas. In various embodiments, the same sinusoidal radiofrequency signal used to excite the antennas (or a replica thereof) is also used for demodulating the signal as received by the calibration antenna, for example by multiplying the received signal together with this radiofrequency signal and low-pass filtering the result, as would be readily understood by a worker skilled in the art.

The calibration controller 130 is further configured to obtain indications of radiated fields of the antennas at a spatial location which corresponds to the location of the calibration antenna. The indications are obtained based on the sequence of measurements, and may be obtained after all members of the sequence of excitation patterns have been applied and the corresponding measurements obtained. Obtaining the indications may therefore include retrieving the stored measurements from memory for processing. Alternatively, a recursive function may be used to process the measurements as they are obtained. The recursive function may be stored in memory and updated as measurements are obtained. The indications are related to the sequence of measurements in that the indications correspond to values of an inverse two-dimensional discrete Fourier transform applied to the measurements.

In some embodiments, the indications of the radiated fields are determined by computing an inverse two-dimensional discrete Fourier transform on the measurements, for example using a processor included in the calibration controller. Various algorithms can be used to perform such computations, with the selected algorithm adequately trading off efficiency versus accuracy. In some embodiments, inverse two-dimensional discrete Fourier transform values corresponding to possible measurements may be pre-computed and stored in a lookup table, and the indications may be derived by a lookup table operation specifying the current measurements. In some embodiments, the indications may be obtained by performing computations by a microprocessor 134 executing program instructions stored in memory. In some embodiments, the indications may be obtained by operation of a digital and/or analog electronic circuit configured to receive electrical signals indicative of the measurements and to output electrical signals indicative of the indications.

In various embodiments, computing the inverse two-dimensional discrete Fourier transform of the sequence of measurements is then performed as follows. For each index value (k,l), a corresponding spectral domain coefficient F(k,l) is set as equal to (or approximately equal to) a corresponding one of the sequence of measurements obtained due to the $(k,l)^{th}$ excitation pattern. The inverse two-dimensional discrete Fourier transform of a two-dimensional function having values F(k,l) is then computed or otherwise obtained.

The calibration controller 130 is further configured to calibrate the antenna array based on the indications of radiated fields of the antennas (as obtained via the inverse Fourier transform relationship). For a given antenna, the obtained indication may be indicative of the relationship between an input signal to the antenna and the signal as received by the calibration antenna due to the input signal. The relationship may include phase and amplitude differences between the input signal and the signal as received. The indication may be provided as or correspond to a complex transfer function, for example. In some embodiments, this relationship or transfer function can be compared to a desired or idealized relationship or transfer function, and a correction factor can be derived from the comparison. The correction factor may indicate the amount of phase shift, gain variation, or other pre-distortion that should be applied to the input signal so that the input/output relationship (or transfer function) more closely matches a desired relationship (or transfer function). The antenna array is then calibrated by adjusting the phase shifters and variable gain amplifiers (or other pre-processing elements) so as to apply the determined correction factor.

Computation of the correction factors may be performed by a microprocessor of the calibration controller executing stored program instructions, or via a lookup table operation which provides pre-computed correction factors for given indications of radiated fields, or by other digital and/or analog electronic circuits configured to provide correction factors, or the like.

The desired relationships or transfer functions to which the observed indications are compared may be pre-defined based on models, experimental measurements, or a combination thereof. For example, electromagnetic modeling software and/or anechoic chamber measurements may be used to determine the desired transfer function indicative of the relationship between the input to a feed network of the array and the output of the calibration antenna, when a single identified antenna of the array transmits. The relationship may be parameterized by gain and phase differences between the input and output signals.

Figure 2:
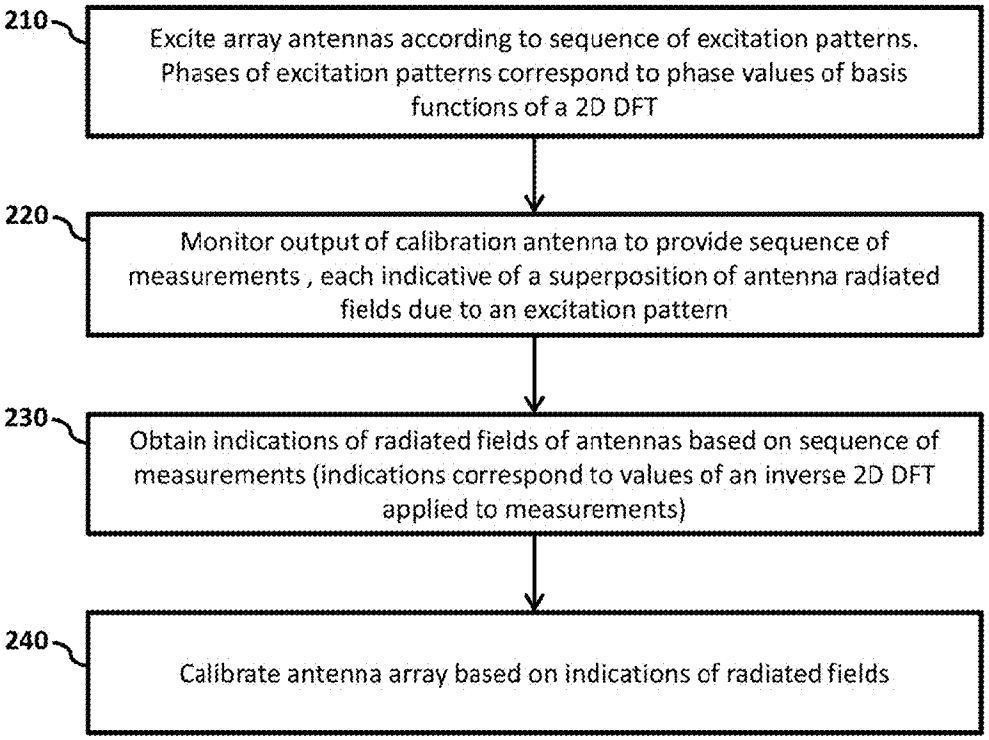
FIG. 2 illustrates a method for calibrating a phased antenna array system, according to embodiments of the present invention.

In view of the above, FIG. 2 illustrates a method for calibrating an antenna array, according to an embodiment of the present invention. The antenna array comprises a plurality of antennas in a two-dimensional arrangement, and each of the antennas is operatively coupled to a respective controllable phase shifter. The method includes exciting 210 the antennas according to a sequence of excitation patterns. Each of the excitation patterns defines a plurality of phases to be applied by the phase shifters during concurrent excitation of the antennas. The phases correspond to phase values of a basis function of a two-dimensional discrete Fourier transform (2D DFT). Each of the excitation patterns is associated with a different basis function of the two-dimensional discrete Fourier transform. The method further includes monitoring 220 output of a calibration antenna to provide a sequence of measurements. Each measurement of the sequence of measurements indicates of response of the calibration antenna due to a superposition of radiated fields of the antennas excited according to a corresponding one of the excitation patterns. The method further includes obtaining 230 indications of radiated fields of the antennas based on the sequence of measurements, the indications corresponding to values of an inverse two-dimensional discrete Fourier transform applied to the measurements. The indications may be obtained via computation, table lookup operation, or the like. The method further includes calibrating 240 the antenna array based on the indications of radiated fields of the antennas.

Having generally described embodiments of the present invention, further details will now be described.

Figure 3:
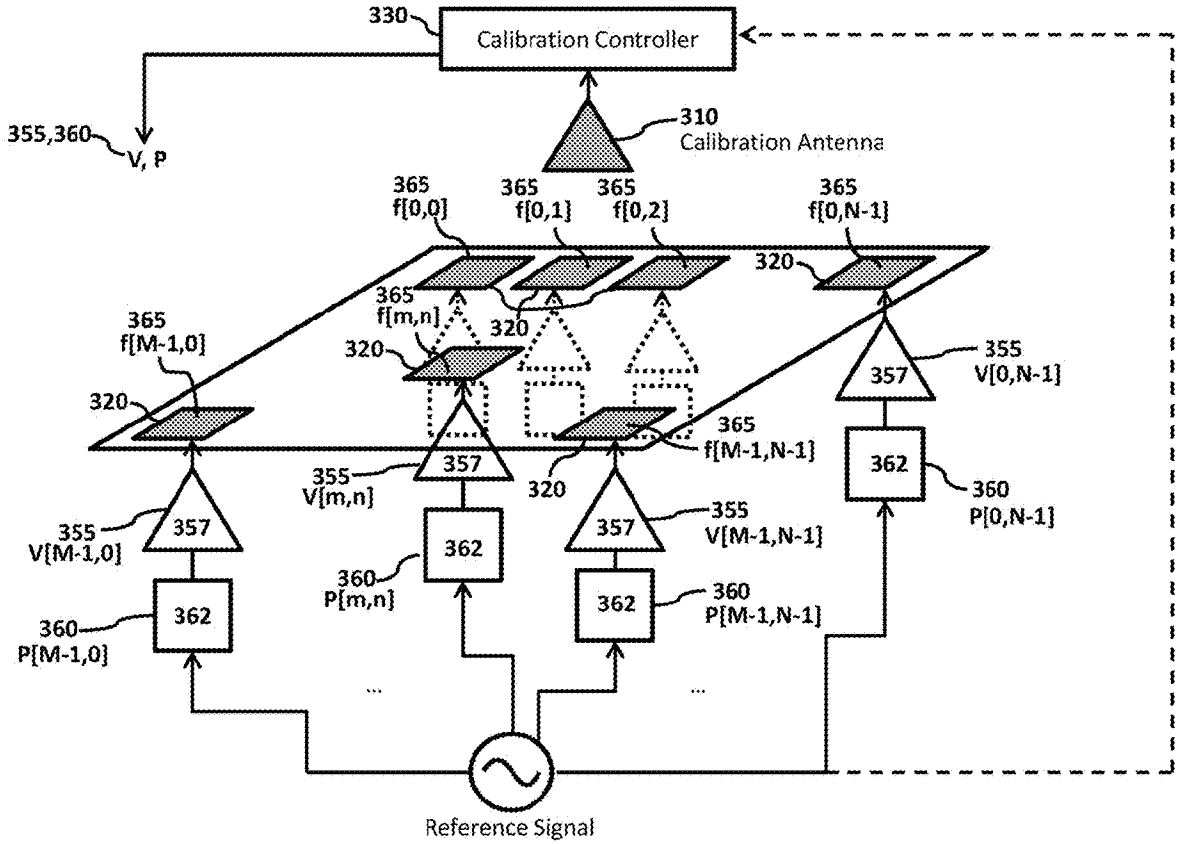
FIG. 3 illustrates another phased antenna array system and calibration apparatus, according to embodiments of the present invention.

FIG. 3 illustrates a phased array antenna with built-in calibration antenna 310, according to another embodiment of the present invention, and which will be referred to in the discussion below. For clarity, only some antennas, and their corresponding phase shifters and amplifiers, are shown.

As set forth above, embodiments of the present invention comprise exciting each individual antenna 320 or a group of antennas 320 with predefined excitation patterns sequentially and measuring the amplitude and phase of radiated field for each excitation pattern using the built-in calibration antenna. Referring to FIG. 3, each excitation pattern is defined as a group of state signals being used to change the state of the antennas, each by a specific phase P 360 (and in various embodiments also by a specific amplitude V 355). The phases P 360 can be applied by corresponding phase shifters 362 and the amplitudes V 355 can be applied by corresponding amplifiers 357. A calibration controller 330 may provide the amplitude and phase information 355, 360 for setting the amplitudes and phases.

In some embodiments, excitation patterns are based at least in part on a priori knowledge of radiation patterns of antennas in presence of the other elements and the calibration antenna and also the radiation pattern of calibration antenna obtained by electromagnetic (numerical) solvers or anechoic chamber measurements. For example, either the electromagnetic solvers or anechoic chamber measurements can be employed to obtain the radiation characteristics of both the phased array antennas and/or the calibration antenna, separately. This approach may also be used to calculate the effect of calibration antenna on the radiation of antenna elements and vice-versa. In this regard, the calibration antenna may be located at the predefined position near the phased array structure and the couplings between all different elements can be measured or simulated.

In various embodiments, following application of the excitation patterns at the antennas and the obtaining of measurements using the calibration antenna, each antenna's radiated electric field (denoted as $f$ 365 in FIG. 3) at the location of calibration antenna is computed, and unknown system parameters are estimated. As such, the calibration antenna may be disposed in the near-field of the array. In various embodiments, the far-field radiation pattern can be determined based on near-field measurements. The computation and estimation are performed by the calibration controller 330 based at least in part on the obtained measurements along with knowledge of the applied excitation patterns.

It is noted that the calibration antenna may be in the near-field of the phase array system as a whole. However, at the same time, the calibration antenna may also be located at the far-field of each antenna (element) of phased array system.

The computed antenna electric fields and estimated system parameters are referred to as calibration information. The calibration information can be used in order to adjust phased antenna array operation, for example by applying appropriate correction factors to amplifiers and phase shifters of the array, for example located in the feed network.

In various embodiments, calibration occurs repeatedly over time, for example on a periodic basis. Notably, the number of excitation patterns applied can vary between different repetitions of the calibration procedure. For example, an initial calibration may apply a greater number of excitation patterns, for example equal to the number of possible data points in the discrete two-dimensional Fourier transform of the two-dimensional function $f$. Once the system is initially calibrated, subsequent recalibration operations can involve a selected number of excitation patterns which is less than the total number of excitation patterns applied during initial calibration.

Excitation Patterns

As mentioned above, embodiments of the present invention comprise exciting selected antennas of the phased antenna array using a sequence of excitation patterns. If an antenna is to remain unexcited during a particular excitation pattern, the gain of the variable gain amplifier can be set to zero for that particular antenna, for example.

Some or all excitation patterns of the sequence are used to excite the antennas of the phased array. Each excitation pattern is defined by a selected set of antennas and the control signals used to excite each member of the selected set of antennas with a specified phase and amplitude. The sequence of excitation patterns may be applied in an arbitrary order.

In some embodiment, the specified amplitude varies between antennas. In some embodiments, the specified amplitude is the same for all antennas. In some embodiments, the specified amplitude is zero for some antennas (i.e. antennas which are to be refrained from being excited) and nonzero for other antennas. The nonzero values can be the same for all antennas. In various embodiments, a group of antennas (e.g. 10 to 30 antennas of a large array) are excited at a time.

According to embodiments of the present invention, the excitation patterns being used belong to a particular group of patterns, namely patterns which provide the spectral information of radiated fields of the array's antennas.

For example, an antenna array may include antennas arranged according to a planar grid pattern, as illustrated in FIG. 3. The grid includes M rows of antennas, indexed from zero to M−1, and N columns of antennas, indexed from zero to N−1. The antenna in the $m^{th}$ row and the $n^{th}$ column is designated by the label [m, n]. The phasor representation of the received signal due to the radiated field of antenna [m, n], as observed at the location of the calibration antenna (sensor) is denoted by $f$[m, n]. That is, $f$[m,n] is a complex number incorporating the amplitude and phase of the radiated field of $[m, n]^{th}$ element of the antenna array at the location of calibration antenna.

Under these conditions, it is noted that the two-dimensional discrete Fourier transform of the two-dimensional function $f$[m,n] takes the form:

$$F[k, l] = \sum_{m=0}^{M-1} \sum_{n=0}^{N-1} f[m, n] e^{-j2\pi\left(\frac{mk}{M} + \frac{nl}{N}\right)}. \quad (1)$$

In various embodiments, $f[m, n]=a_{mn}e^{j\varphi_{mn}}$ and is a complex number incorporating the amplitude and phase of received signal due to radiated field of $[m,n]^{th}$ element at the location of calibration antenna. This can also be expressed as $a_{mn}\cos(\omega_r t+\varphi_{mn})$ in the time domain representation.

The antenna array's phase shifters are set (via control signals) for values corresponding to phase shifts of $$-2\pi\left(\frac{mk}{M}+\frac{nl}{N}\right)$$

with l and k being constant (for a given excitation pattern) and m and n varying with antenna location. The VGAs of the different antennas can be set to a common gain.

Obtaining Measurements Via Calibration Antenna

The calibration antenna measures a signal due to a superposition of radiated fields of all of the excited antennas at the location of the calibration antenna. In various embodiments, the amplitude and phase of this signal provides the value of the Fourier transform at the $[k, l]^{th}$ point corresponding to a particular [x, y] coordinate in the spectral domain. Namely, the coordinate in the spectral domain has x value $$F_x=\frac{2\pi}{M}k$$

and y value $$F_y=\frac{2\pi}{N}l.$$

In some embodiments, the measurements provided by the calibration antenna can be obtained by using the same sinusoidal reference signal used in the transmitter to feed the antennas as the local oscillator in the receiver antenna to down-convert the received signal for phase and amplitude extraction (see FIG. 3). To do so, a number $N_t \times N_s$ of samples are collected by the receiver, so as to obtain $N_s$ samples from each of $N_t$ periods of received signal, given by $\tilde{a}_{kl}\cos(\omega_r t+\tilde{\varphi}_{kl})$. The received signal $\tilde{a}_{kl}\cos(\omega_r t+\tilde{\varphi}_{kl})$ is denoted $F[k, l]=\tilde{a}_{kl}\exp(j\tilde{\varphi}_{kl})$ (Eq. (1)). The received signal (like $f[m,n]$) is a complex number incorporating the amplitude and phase of $[k,l]^{th}$ element of the two-dimensional discrete Fourier transform.

In more detail, the calibration antenna receives the summation of signals due to all antenna elements excited and radiating according to the current excitation pattern. The signal received by the calibration can be represented in phasor form by F[k,l] which is as specified in Equation (1). F is the discrete Fourier transform of $f$. The calibration receiver measures the phase and amplitude of the received signal: $\tilde{a}_{kl}\cos(\omega_r t+\tilde{\varphi}_{kl})$ which, in the phasor form, gives $F[k, l]=\tilde{a}_{kl}\exp(j\tilde{\varphi}_{kl})$. One way to determine the phase and amplitude is by taking $N_s$ samples from $N_t$ periods of received signal: $\tilde{a}_{kl}\cos(\omega_r t+\tilde{\varphi}_{kl})$.

It is noted that the received signal, being a summation of sinusoidal signals having the same frequency (but different amplitudes and phases), is also a sinusoidal signal. This can be demonstrated by the following equation:

$$\sum_{i=1}^{N}A_i\cos(wt+\varphi_i)=\mathrm{Re}\left\{\sum_{i=1}^{N}A_i e^{j(wt+\varphi_i)}\right\}=$$
$$\mathrm{Re}\left\{\sum_{i=1}^{N}A_i e^{j(\varphi_i)}e^{j(wt)}\right\}=\mathrm{Re}\{Ae^{j(\varphi)}e^{j(wt)}\}=A\cos(wt+\varphi).$$

Here, $$Ae^{j(\varphi)}=\sum_{i=1}^{N}(A_i e^{j(\varphi_i)}).$$

Obtaining Indications of Radiated Fields

Performing the total number of M×N measurements for all [k,l] points in the spectral domain, the discrete two-dimensional Fourier transform F of the two dimensional discrete signal $f$ is obtained. Taking the inverse Fourier transform, the $f[m, n]$ values are obtained as:

$$f[m,n]=\left(\frac{1}{MN}\right)\sum_{k=0}^{M-1}\sum_{l=0}^{N-1}F[k,l]e^{j2\pi\left(\frac{mk}{M}+\frac{nl}{N}\right)}. \quad (2)$$

As mentioned above, $f[m, n]$ indicates the radiated field (e.g. amplitude and phase thereof) of each antenna, as observed at the location of the calibration antenna. This value, in general, is different from the radiated field of an ideal (calibrated) antenna. For instance, the $[m,n]^{th}$ element's phase response to the control signal, for $$-2\pi\left(\frac{mk}{M}+\frac{nl}{N}\right)$$

phase shift, is not necessarily equal to $$-2\pi\left(\frac{mk}{M}+\frac{nl}{N}\right).$$

The phase response depends on the initial phase of the components and is subject to unavoidable drifts. The differences between ideal and actual phase are absorbed in the coefficients of the $f[m, n]$ values. One of the purposes of calibration is to extract these differences for all antenna elements. The differences can be then be applied as offset signals (correction factors) for adjusting the phase shifters.

As such, instead of directly measuring the radiated field of each antenna ($f[m, n]$) sequentially by turning on one antenna at a time, a spectral sampling scheme is employed. The applied excitation patterns involve multiple (e.g. all) antennas being excited simultaneously with a particular phase shift distribution. Each applied excitation pattern includes a different phase shift distribution, and corresponds to one point in the spectral domain representation of signal of interest.

A first potential advantage of this approach is that, because all antennas are radiating, the signal to noise ratio (SNR) at the calibration antenna (sensor) may be significantly enhanced, as compared to the SNR in other methods in which only one antenna is excited at a time for each measurement.

Spectral Sampling

A second potential advantage of this approach is as follows. For perfectly calibrated systems, or systems slightly different from the calibrated systems, a considerable number of spectral coefficients become fairly small as compared to the rest of the coefficients. This leads to a potentially significant reduction in the number of necessary measurements, because the excitation patterns which correspond to negligible values of F[k,l] can be skipped. This approach may be used for a variety of phased array systems, for example which employ antennas with high directivity. This accelerates the process of recalibrating the systems which have been calibrated once before and small correcting changes are expected to be applied to the phase shifters and amplifiers.

Depending on the radiation pattern of each antenna, which may be the same as other antennas, and the distance of the calibration antenna from the plane of phased array antennas, the spectral information of the radiated field changes. When the location of antennas and the calibration antenna are fixed, the spectral domain features such as the location of non-zero coefficients of discrete Fourier transform in spectral domain may also be fixed. In other words, the [k,l] values corresponding to these coefficients may be substantially known (for calibrated systems). Therefore, there is little or no need to excite the patterns associated with coefficients having values close to zero or very small compared to other coefficients. This property is useful for example when the errors in phase shifters or amplifiers are bounded to certain limits. Otherwise, proper identification of the system may require excitation of the array antennas according to all of the (M×N) defined excitation patterns, in order to measure all spectral coefficients. This is typically the case for systems which have not been calibrated before.

In various embodiments, therefore, the antenna array is excited using a sequence of excitation patterns which belong to a strict subset of all applicable excitation patterns. The applicable excitation patterns correspond to those discrete values of k and l for which the coefficients of the Fourier transform function F[k,l] are defined. For the two-dimensional array with M×N antennas, there are also M×N applicable excitation patterns (since m and k can take on integer values from 1 to M and n and l can take on integer values from 1 to N). Exciting the antenna array using a strict subset of the applicable excitation patterns therefore means that fewer than M×N excitation patterns are applied.

In particular, excitation patterns can be selected for inclusion in the subset based on the predicted value of their corresponding coefficients F[k,l]. For example, when a coefficient is expected to be greater than a predetermined threshold value, then the corresponding excitation pattern is included in the subset. As another example, the size of the subset can be set at a value Q which is less than the total number of applicable excitation patterns. The excitation patterns corresponding to the Q highest coefficients can then be included in the subset. The size of the subset can be set (e.g. by setting the threshold value or value Q) based on various considerations, for example in order to trade off calibration speed and accuracy. A smaller subset results in a shorter calibration time, because fewer excitation patterns are applied. However, accuracy of the calibration depends on the excluded excitation patterns corresponding to sufficiently negligible Fourier coefficients, which in turn depends on accurate prediction of the coefficient values. Therefore, the expected prediction accuracy should be taken into account when configuring the subset; when expected prediction accuracy is high, the subset size may be increased, whereas when expected prediction accuracy is low, the subset size may be decreased. Expected accuracy may depend on factors such as elapsed time since last calibration, changes in environmental conditions such as temperature, movement of the antenna array, or the like.

In various embodiments, the number of excitation patterns Q≤M×N used is selected so as to measure a selected number Q of samples of the discrete Fourier transform F(.) of the two dimensional function $f(.)$. As already mentioned, $f(.)$ is a mapping from two-dimensional values (m,n) to a complex value indicative of the amplitude and phase of a signal received at the calibration antenna due to the field radiated by the antenna having index [m,n]. The complex value given by $f(m,n)$ is proportional to the radiated field of $[m,n]^{th}$ antenna element evaluated at the location of the calibration antenna. The process of measuring the Q samples can be considered to be a form of spectral sampling.

Figure 4A:
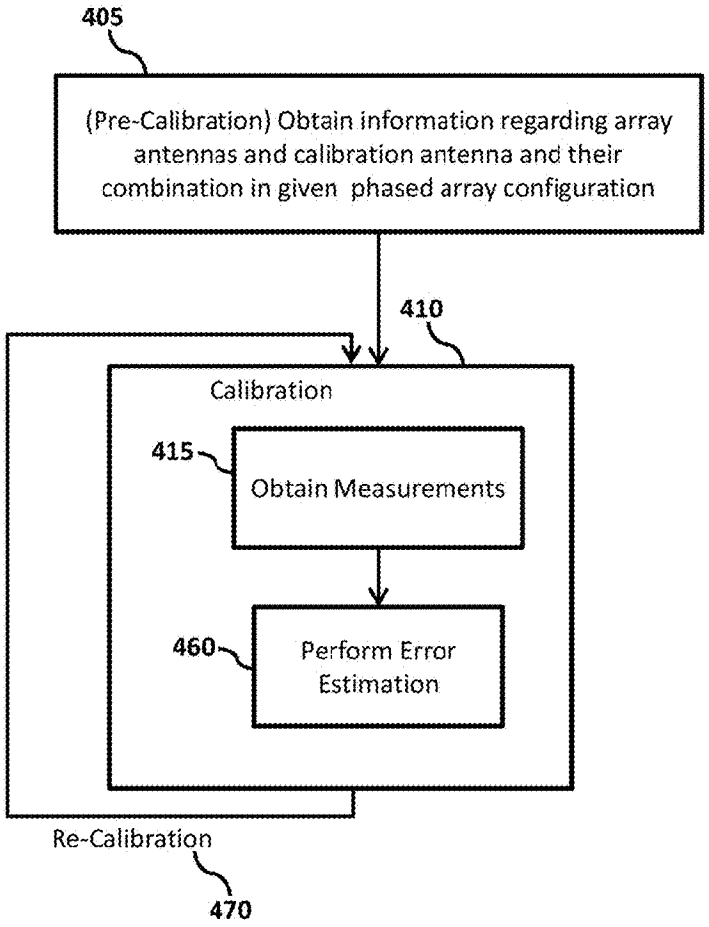
FIGS. 4A and 4B illustrate operations related to calibrating a phased antenna array system, according to embodiments of the present invention.
Figure 4B:
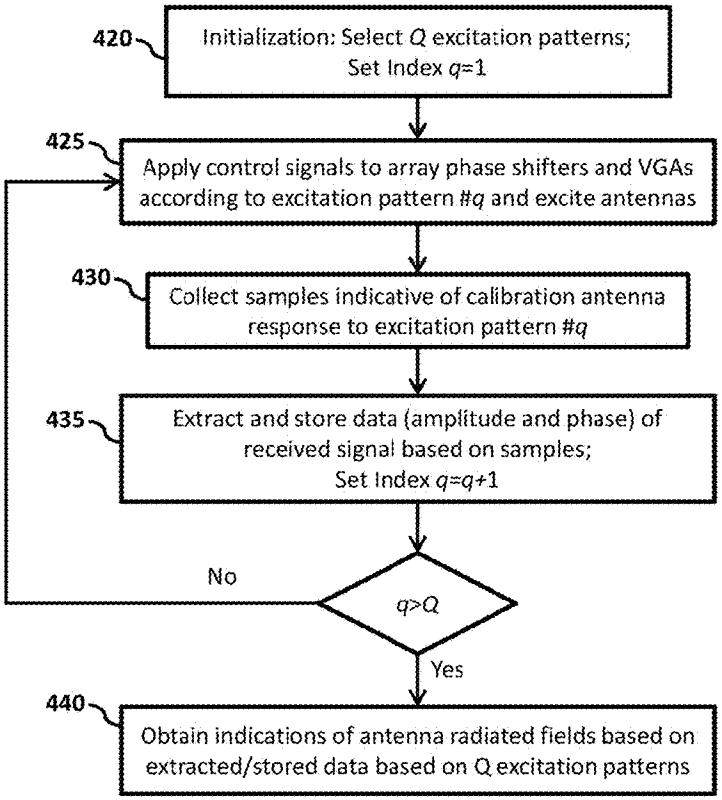

FIGS. 4A and 4B illustrate pre-calibration, calibration and recalibration operations according to an embodiment of the present invention. Referring now to FIG. 4A, pre-calibration 405 comprises obtaining information regarding the array antennas and the calibration antenna and their combination in the given phased array configuration. This may be performed using simulation, electromagnetic solvers, anechoic chamber measurements, or the like. The information obtained from pre-calibration 405 may include the observed and/or desired radiation patterns of antennas for both the phased array system and the calibration antenna. The pre-calibration information can then be used in the calibration and recalibration operations. Pre-calibration 405 may be performed once, for example during manufacture or prior to or during antenna array deployment. The first time the calibration operation 410 is performed after pre-calibration 405 is referred to as the initial calibration. Subsequent calibration operations 410 are referred to as re-calibration 470.

The calibration operation 410 includes obtaining measurements 415 and subsequently performing error estimation 460.

In various embodiments, obtaining measurements 415 comprises a number of sub-operations described as follows, with reference now to FIG. 4B. In an initialization operation 420, a number Q of excitation patterns are selected and an index variable q is set equal to 1. As described above, each excitation pattern can be defined by a pre-specified phase assigned to each antenna element. The phases can be set via control signals applied to the array's phase shifters, and also, in some embodiments, by a pre-specified amplitude assigned to each antenna element. The amplitudes can be set via control signals applied to the array's variable gain amplifiers.

Next, the antennas are excited according to the excitation patterns and the output of the calibration antenna is monitored to provide a sequence of measurements. Starting with the first excitation pattern, i.e. corresponding to q=1, and repeating for q=2, 3, 4 . . . Q, the antennas are excited according to each excitation pattern sequentially, by applying 425 suitable control signals to the array phase shifters (and VGAs) for each antenna in order to adjust the amplitudes and phase shifts in accordance with the current excitation pattern (and also applying a radiofrequency reference signal to which is adjusted by the VGAs and phase shifters and excites the antennas.

In addition, a number of samples received by the calibration antenna are collected 430, the samples indicative of the calibration antenna response to the current excitation pattern. In one embodiment, taking $N_s \times N_t$ samples are obtained as described above, for example using an in-phase/quadrature receiver. Further, data such as the amplitude and phase of the received signal is extracted 435 (determined) based on the samples, and the results stored in memory in association with the current excitation pattern. The next excitation pattern is then applied and the above steps 425, 430, 435 are repeated until all Q excitation patterns have been applied.

Following application of all Q excitation patterns, indications of radiated fields of the antennas can be obtained 440 (e.g. calculated or estimated) based on the extracted and stored data obtained due to the excitation patterns. The indications correspond to values of an inverse two-dimensional discrete Fourier transform applied to the measurements, and can be calculated via Equation (2) or via equivalent methods, such as lookup table operations.

The error estimation 460 comprises extracting, based on the indications of the radiated fields and other stored data such as pre-calibration information, unknown system parameters such as the phase behaviour of the array phase shifters and the gain behaviour of the array VGAs. Based on these parameters, the array can be calibrated or adjusted to operate within desired tolerances. Using the obtained indications of radiated fields of the antennas and previously measured or simulated information obtained from pre-calibration, the unknown system parameters can be obtained.

The re-calibration operation 470 comprises repeating the calibration operation 410, for example periodically, on an as-needed basis in response to monitored performance metrics falling below a threshold, or in response to an environmental (e.g. temperature) change or other operational change over time.

Once the system is initially calibrated using the procedure described above, the system may be re-calibrated during normal operation, for example periodically. However, it is desirable to limit recalibration in order to prevent or mitigate large service interruption. As such, various embodiments of the present invention employ a spectrally compressed sampling scheme in which, instead of exciting the antennas according to all possible excitation patterns, a subset of all excitation patterns is selected for use during recalibration.

The selection of excitation patterns may be based on spectral information of electric field. Due to the elimination of some of the excitation patterns, the antenna radiation information can be obtained from the measured signals more quickly but with a certain level of error. In some embodiments, comparing the new calibration data with those of the calibrated system determines if the differences are significant enough to increase the number of measurements by including more excitation patterns.

The use of a subset of excitation patterns in recalibration is based on an assumption of limited drift in the array calibration. Essentially, the rate and/or amount of drift in calibrated components such as phase shifters and VGAs is assumed to be limited, which allows the recalibration to be performed using fewer measurements than the initial calibration.

For a variety of antenna arrays, it can be shown, for example based on the simulation and measurement results, that the signal matrix F [k, l] is sparse. In other words, a significant number of the F[k,l] values are substantially zero or negligible. The [k,l] values corresponding to the locations of zeros of F can be determined based on the simulation and measurement results, and can be assumed to be fixed, provided that the radiation characteristics and the location of calibration antenna with respect to the system is also fixed, which is a reasonable assumption in many practical cases.

The re-calibration operation proceeds similarly to the initial calibration operation. The location of the most significant elements of the signal matrix F[k, l] can be determined, for example based on simulation and measurement results. Based on this knowledge, Q' excitation patterns, which includes some of the Q excitation patterns of the initial calibration but also excludes others, are selected. The Q' excitation patterns are selected as those corresponding to non-negligible values of the signal matrix F[k,l]. Instead of performing Q measurements, now, Q' (<Q) measurements are made, and estimates of $f[m,n]$ are obtained based on the Q' measurements. In large phased array systems, this approach can save significant time by reducing the required number of measurements and excitation patterns.

In some embodiments, different calibration or re-calibration operations may involve applying different sets of excitation patterns. In the above case, the set of excitation patterns Q' is contained in Q, however in other cases different sets may be disjoint or overlapping. Different calibration operations may then obtain indications of the antenna radiated fields based on different spectral samples. In some embodiments, the indications may be aggregated together, averaged, or the like.

Obtaining the indications of the antenna radiated fields based on a spectral sample comprising less than all possible values of F[k,l] can be performed in a variety of ways. In one embodiment, the indications can be obtained based on Equation (2) (or an associated lookup or other operation), except that the values of F[k,l] corresponding to excitation patterns which were not applied in the calibration or re-calibration are replaced with zeros. In other embodiments, the indication of antenna radiated fields can be directly measured for the antennas relatively near the calibration antenna. This may be the case for those array antennas having signals which exhibit a higher signal-to-noise ratio at the calibration antenna (due to proximity). In other embodiments, different excitation patterns can be chosen to further improve accuracy. In particular, the extraction of the radiated signals for each array antenna can be achieved through different linear combinations of measured signals, relative to the linear combination expressed in Equation (2).

The need for performing a complete calibration procedure may arise after the system has been operating for a long time or if for any reason there may be large drifts in the phase shifters or amplifiers characteristics. In this case the initial calibration process can be performed again.

Error Estimation

Having measured the spectral domain coefficients F[k, l], the $f[m, n]$ values are estimated via an inverse Fourier transform relationship, for example via computing an inverse Fourier transform of the measured data, as described above. Based on prior information regarding the radiated field of antennas, for example as previously obtained analytically or by using EM solvers or measurements, the actual phase shift values and gain values applied by the array's phase shifters and amplifiers can be estimated. The difference between actual and desired values can be used to adjust control of the phase shifters and amplifiers, thereby calibrating them.

Moreover, in some embodiments, the errors associated with positioning of antennas with respect to calibration antenna can be determined, at least approximately. In one embodiment, the Taylor series expansion about the parameters $x_i, y_i, z_i, A_{PS,i}, \varphi_{PS,i}, A_{VGA,i}, \varphi_{VGA,i}$ can be made use of in determining such errors. Here, $x_i$, $y_i$, $z_i$ represent the approximate relative locations of antennas, $A_{PS,i}, \varphi_{PS,i}$ represent the approximate amplitude and phase responses of the array phase shifters, respectively, and $A_{VGA,i}$,$\varphi_{VGA,i}$ represent the approximate amplitude and phase responses of the array VGAs, respectively. If for a particular antenna the measured signal is denoted as $f[m, n]$, then:

$$f[m, n] = R_{mn}(x, y, z, A_{PS}, \varphi_{PS}, A_{VGA}, \varphi_{VGA}) = R_{mn}(x_i^{mn}, y_i^{mn}, z_i^{mn}, A_{PS,i}^{mn}, \varphi_{PS,i}^{mn}, A_{VGA,i}^{mn}, \varphi_{VGA,i}^{mn}) + \frac{\partial R_{mn}}{\partial x}\Delta x + \frac{\partial R_{mn}}{\partial y}\Delta y + \frac{\partial R_{mn}}{\partial z}\Delta z + \frac{\partial R_{mn}}{\partial A_{PS}^{mn}}\Delta A_{PS}^{mn} + \frac{\partial R_{mn}}{\partial \varphi_{PS}^{mn}}\Delta\varphi_{PS}^{mn} + \frac{\partial R_{mn}}{\partial A_{VGA}^{mn}}\Delta A_{VGA}^{mn} + \frac{\partial R_{mn}}{\partial \varphi_{VGA}^{mn}}\Delta\varphi_{VGA}^{mn}, \quad (3)$$

In the above, R(.) is a complex function depending on the radiation pattern of calibration antenna and phased array antenna, the geometrical orientation of antennas and the distance between the antennas. R can be written as:

$$R_{mn} = A_{mn}\exp(j\varphi_{mn})A_{VGA}^{mn}(v_{VGA})\exp(j\varphi_{VGA}^{mn}(v_{VGA}))A_{PS}^{mn}(v_{PS})\exp(j\varphi_{PS}^{mn}(v_{PS}))\times\sqrt{\rho_{mn}(\theta_{mn}, \varphi_{mn})}\sqrt{g_{mn}(\theta_{mn}, \varphi_{mn})}\frac{\exp(-jkr_{mn})}{4\pi r_{mn}} \quad (4)$$

where $r_{mn}=\sqrt{(x^{mn})^2+(y^{mn})^2+(z^{mn})^2}$, and $\sqrt{\rho_{mn}(\theta_{mn},\varphi_{mn})}$ and $\sqrt{g_{mn}(\theta_{mn},\varphi_{mn})}$ incorporate the variation of signal's amplitude associated with the polarization mismatch and directional gain of the both transmitter and calibration antennas for the [m, n]th transmitter's element. Having measured or calculated $R_{mn}$ for all pairs of phased array elements and calibration antenna, initial values for parameters are chosen. Equation (3) can be solved for errors iteratively for all antennas. To do so, initially one of the errors to is set to an initial value and all the other errors are set to zero. Dividing the difference of $f[m, n]$ and $R_{mn}(x_i^{mn},y_i^{mn},z_i^{mn},A_{PS,i}^{mn},\varphi_{PS,i}^{mn},A_{VGA,i}^{mn},\varphi_{VGA,i}^{mn})$ by the coefficient ahead of the unknown error, the shifting value is obtained. Next, error values are updated by adding their previous values to the obtained shifting value. More accurate estimation of error can be obtained iteratively while minimizing the absolute difference between $f[m, n]$ and $R_{mn}(x_i^{mn},y_i^{mn},z_i^{mn},A_{PS,i}^{mn},\varphi_{PS,i}^{mn},A_{VGA,i}^{mn},\varphi_{VGA,i}^{mn})$. The same or a similar procedure can be performed for other types of errors, while for each of them the values of all other errors are set to their last iteration values.

It will be appreciated that, although specific embodiments of the technology have been described herein for purposes of illustration, various modifications may be made without departing from the scope of the technology. In particular, it is within the scope of the technology to provide a computer program product or program element, or a program storage or memory device such as a magnetic or optical wire, tape or disc, or the like, for storing signals readable by a machine, for controlling the operation of a computer according to the method of the technology and/or to structure some or all of its components in accordance with the system of the technology.

Non-Planar/Non-Grid Arrays

As noted above, embodiments of the present invention are applicable to arrays of antennas such as antennas disposed on a planar surface in a grid pattern, or to another phased array antenna architecture with a different spatial arrangement of antenna elements. This general applicability is due to the fact that the radiated fields of any type of radiating object(s) or system(s), regardless of their physical configuration, can be described in terms of the electromagnetic fields over an arbitrary mathematical surface which encloses the actual radiator. The radiator may be a general conformal phased array system in the present invention. This observation is based upon the Electromagnetic Equivalence Theorem (or Huygens Principle in optics). If the mathematical surface is chosen as having a planar form (which is compatible with the present Fourier transform formulation) then, provided that the size of this planar surface is sufficiently large to capture all the radiation from the actual radiator, the field radiated by this mathematical planar equivalent source will be identical to that of the actual radiator. Furthermore, the field sampling points on this equivalent planar source can be chosen over a rectangular grid of points. This provides compatibility with the Fourier transform formulation described above. Therefore, in this manner, the approach described herein for a planar array can be extended to an array structure with arbitrary geometry by adding a linear transformation between the actual radiator (the general non-planar array with a non-uniform grid) and an equivalent mathematical planar array with a rectangular grid.

It is further noted that the spatial arrangement of antenna elements (i.e. whether in a planar grid pattern or other conformal pattern) does not change the measurement procedure of the present invention. Thus, the excitation basis functions, the manner of indexing and so on, may be as described above for a variety of non-planer and/or non-grid arrangements of antennas. As long as the calibration probe (antenna) is properly positioned over the mathematical planar surface described above, the same procedure as described with respect to the planar grid array may be used. However, due to the conformal configuration of antenna elements, the measured signals may not feature some desired properties, such as the sparsity property of the signal matrix. In this case the linear transformation described above may be used to determine the amplitudes and/or phases of the actual array from the amplitudes and/or phases of the mathematical array elements, and vice-versa. The result of this transformation provides the required excitation pattern (both phases and amplitudes) needed to excite the antenna elements.

As such, embodiments of the present invention comprise, for an antenna array having its antennas in a non-planar and/or non-grid arrangement, performing a linear transformation operation in order to translate between calibration data of the antenna array and corresponding calibration data of an equivalent virtual antenna array having its antennas arranged in a planar grid arrangement. The calibration data may include amplitudes and phases of calibration signals used to drive the antennas, calibration correction factors, properties of received calibration signal components, and the like. The linear transformation operation may be performed by a computer, or via a lookup table operation, equivalent electronic circuit operation, or the like.

Acts associated with the method described herein can be implemented as coded instructions in a computer program product. In other words, the computer program product is a computer-readable medium upon which software code is recorded to execute the method when the computer program product is loaded into memory and executed on the microprocessor of the wireless communication device.

Further, each step of the method may be executed on a computing device, such as a microprocessor, microcontroller, personal computer, server, or the like and pursuant to one or more, or a part of one or more, program elements, modules or objects generated from a programming language, such as C++, Java, or the like. In addition, each step, or a file or object or the like implementing each said step, may be executed by special purpose hardware or a circuit module designed for that purpose.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

The embodiments of the invention for which an exclusive property or privilege is claimed are defined as follows:

1. A method for calibrating an antenna array comprising a plurality of antennas in a two-dimensional arrangement, each of the antennas operatively coupled to a respective controllable phase shifter, the method comprising:

exciting the antennas according to a sequence of excitation patterns, each of the excitation patterns defining a plurality of phases to be applied by the phase shifters during concurrent excitation of the antennas, wherein the plurality of phases correspond to phase values of a basis function of a two-dimensional discrete Fourier transform, and wherein each of the excitation patterns is associated with a different basis function of the two-dimensional discrete Fourier transform;

monitoring output of a calibration antenna to provide a sequence of measurements, each measurement of the sequence of measurements indicative of response of the calibration antenna due to a superposition of radiated fields of the antennas excited according to a corresponding one of the excitation patterns;

obtaining indications of radiated fields of the antennas based on the sequence of measurements, the indications corresponding to values of an inverse two-dimensional discrete Fourier transform applied to the measurements; and calibrating the antenna array based on the indications of radiated fields of the antennas.

2. The method of claim 1, wherein each of the antennas is further operatively coupled to a respective controllable variable gain amplifier, and wherein each of the excitation patterns further defines a plurality of amplitudes for use in exciting the different respective ones of the antennas via control of the variable gain amplifiers.

3. The method of claim 1, wherein each of the sequence of excitation patterns corresponds to a different two-dimensional discrete index value (k,l), and wherein, for each of the index values (k,l), the basis function associated with the excitation pattern corresponding to the index value (k,l) is a two-dimensional function over discrete variables (m,n) given by:

$$e^{-j2\pi\left(\frac{mk}{M}+\frac{nl}{N}\right)}.$$

4. The method of claim 1, wherein each of the plurality of excitation patterns corresponds to a different two-dimensional discrete index value (k,l), and wherein computing the inverse two-dimensional discrete Fourier transform of the sequence of measurements comprises: for each index value (k,l), setting a corresponding spectral domain coefficient F(k,l) equal to one of the sequence of measurements obtained due to the $(k,l)^{th}$ excitation pattern; and computing the inverse two-dimensional discrete Fourier transform of a two-dimensional function having values F(k,l).

5. The method of claim 1, wherein the sequence of excitation patterns excludes one or more possible excitation patterns, and wherein the inverse two-dimensional discrete Fourier transform is approximated based on the measurements.

6. The method of claim 5, further comprising excluding possible excitation patterns which are predicted to result in relatively small spectral domain coefficients.

7. The method of claim 1, further comprising performing a recalibration operation after calibrating the antenna array, the recalibration operation comprising:

exciting the antennas according to a second sequence of excitation patterns, the second sequence being a strict subset of the sequence of the excitation patterns;

monitoring output of the calibration antenna to provide a second sequence of measurements, each measurement of the second sequence of measurements indicative of response of the calibration antenna due to superposition of radiated fields of the antennas excited according to a corresponding one of the second sequence of excitation patterns;

obtaining second indications of radiated fields of the antennas based on the second sequence of measurements, the second indications corresponding to values of the inverse two-dimensional discrete Fourier transform applied to the second sequence of measurements; and recalibrating the antenna array based on the second indications of radiated fields of the antennas.

8. The method of claim 1, wherein exciting the antennas comprises providing a common sinusoidal signal as input to each of the controllable phase shifters, and wherein at least one measurement of the sequence of measurements indicates an amplitude and a phase of a sinusoidal electrical signal provided by the calibration antenna due to the superposition of radiated fields, the phase being relative to the common sinusoidal signal.

9. The method of claim 1, wherein calibrating the antenna array comprises calibrating one or both of: the controllable phase shifters; and amplifiers operatively coupled to the antennas.

10. The method of claim 1, wherein calibrating the antenna array comprises determining errors associated with positioning of the antennas relative to one another, relative to the calibration antenna, or both, and adjusting operation of the antenna array to compensate for said errors.

11. A calibration apparatus for an antenna array having a plurality of antennas in a two-dimensional arrangement, each of the antennas operatively coupled to a respective controllable phase shifter, the calibration apparatus comprising:

a calibration antenna configured to generate an electrical signal in response to radiated fields generated by the antennas;

a calibration controller configured to:

cause excitation of the antennas according to a sequence of excitation patterns, each of the excitation patterns defining a plurality of phases to be applied by the phase shifters during concurrent excitation of the antennas, wherein the plurality of phases correspond to phase values of a basis function of a two-dimensional discrete Fourier transform, and wherein each of the excitation patterns is associated with a different basis function of the two-dimensional discrete Fourier transform;

monitor output of the calibration antenna to provide a sequence of measurements, each measurement of the sequence of measurements indicative of response of the calibration antenna due to a superposition of the radiated fields of the antennas excited according to a corresponding one of the excitation patterns;

obtain indications of radiated fields of the antennas based on the sequence of measurements, the indications corresponding to values of an inverse two-dimensional discrete Fourier transform applied to the measurements; and calibrate the antenna array based on the indications of radiated fields of the antennas.

12. The calibration apparatus of claim 11, wherein each of the antennas is further operatively coupled to a respective controllable variable gain amplifier, and wherein each of the excitation patterns further defines a plurality of amplitudes for use in exciting the different respective ones of the antennas via control of the variable gain amplifiers.

13. The calibration apparatus of claim 11, wherein each of the plurality of excitation patterns corresponds to a different two-dimensional discrete index value (k,l), and wherein, for each of the index values (k,l), the basis function associated with the excitation pattern corresponding to the index value (k,l) is a two-dimensional function over discrete variables (m,n) given by:

$$e^{-j2\pi\left(\frac{mk}{M}+\frac{nl}{N}\right)}.$$

14. The calibration apparatus of claim 11, wherein each of the plurality of excitation patterns corresponds to a different two-dimensional discrete index value (k,l), and wherein computing the inverse two-dimensional discrete Fourier transform of the sequence of measurements comprises: for each index value (k,l), setting a corresponding spectral domain coefficient F(k,l) equal to one of the sequence of measurements obtained due to the $(k,l)^{th}$ excitation pattern; and computing the inverse two-dimensional discrete Fourier transform of a two-dimensional function having values F(k,l).

15. The calibration apparatus of claim 11, wherein the sequence of excitation patterns excludes one or more possible excitation patterns, and wherein the inverse two-dimensional discrete Fourier transform is approximated based on the measurements.

16. The calibration apparatus of claim 15, further configured to exclude possible excitation patterns which are predicted to result in relatively small spectral domain coefficients.

17. The calibration apparatus of claim 11, wherein the calibration controller is further configured to perform a recalibration operation after calibrating the antenna array, the recalibration operation comprising:

exciting the antennas according to a second sequence of excitation patterns, the second sequence being a strict subset of the sequence of the excitation patterns;

monitoring output of the calibration antenna to provide a second sequence of measurements, each measurement of the second sequence of measurements indicative of response of the calibration antenna due to superposition of radiated fields of the antennas excited according to a corresponding one of the second sequence of excitation patterns;

obtaining second indications of radiated fields of the antennas based on the second sequence of measurements, the second indications corresponding to values of the inverse two-dimensional discrete Fourier transform applied to the second sequence of measurements; and recalibrating the antenna array based on the second indications of radiated fields of the antennas.

18. The calibration apparatus of claim 11, wherein exciting the antennas comprises providing a common sinusoidal signal as input to each of the controllable phase shifters, and wherein at least one measurement of the sequence of measurements indicates an amplitude and a phase of a sinusoidal electrical signal provided by the calibration antenna due to the superposition of radiated fields, the phase being relative to the common sinusoidal signal.

19. The calibration apparatus of claim 11, wherein calibrating the antenna array comprises calibrating one or both of: the controllable phase shifters; and amplifiers operatively coupled to the antennas.

20. The calibration apparatus of claim 11, wherein calibrating the antenna array comprises determining errors associated with positioning of the antennas relative to one another, relative to the calibration antenna, or both, and adjusting operation of the antenna array to compensate for said errors.

21. A phased antenna array comprising the calibration apparatus of claim 11.

* * * * *